US005419451A

United States Patent [19]

Bitel, Jr.

[11] Patent Number: 5,419,451

[45] Date of Patent: May 30, 1995

[54] STACKING TRAY AND LID ASSEMBLY

[75] Inventor: Vincent J. Bitel, Jr., Middletown, Conn.

[73] Assignee: Design Specialties, Inc., Wallingford, Conn.

[21] Appl. No.: 150,619

[22] Filed: Nov. 10, 1993

[51] Int. Cl.[6] ..... B65D 41/16

[52] U.S. Cl. ..... 220/306; 206/508

[58] Field of Search ..... 220/23.83, 306, 356, 220/500; 206/508, 557

[56] References Cited

U.S. PATENT DOCUMENTS

| | | | |
|---|---|---|---|
| D. 207,726 | 5/1967 | Whelan | D44/10 |
| D. 252,179 | 6/1979 | Cherry | D7/1 |
| D. 254,599 | 4/1980 | Otto | D9/185 |
| D. 258,632 | 3/1981 | Commisso | D7/38 |
| D. 275,925 | 10/1984 | Bowen et al. | D7/357 |
| D. 283,666 | 5/1986 | Holzkopf | D7/38 |
| D. 284,727 | 7/1986 | Gerber | D7/21 |
| D. 318,207 | 7/1991 | Anderson | D7/549 |
| 1,511,265 | 10/1924 | Chilson | D7/553 |
| 2,533,159 | 12/1950 | Yates | 220/42 |
| 2,695,115 | 11/1954 | Roop | 220/42 |
| 2,941,562 | 6/1960 | Ripin | 150/0.5 |
| 3,117,692 | 1/1964 | Carpenter et al. | 220/306 |
| 3,240,610 | 3/1966 | Cease | 99/171 |
| 3,275,329 | 9/1966 | Lieberman et al. | 276/44 |
| 3,561,668 | 2/1971 | Bergstrom | 229/43 |
| 3,583,596 | 6/1971 | Brewer | 220/306 |
| 3,883,036 | 5/1975 | Mahaffy et al. | 220/306 |
| 4,026,457 | 5/1977 | Schubert | 229/2.5 R |
| 4,194,645 | 3/1980 | Zabner et al. | 220/306 |
| 4,286,713 | 9/1981 | Marchais | 206/508 |
| 4,494,674 | 1/1985 | Roof | 220/306 |
| 4,508,235 | 4/1985 | Steele et al. | 220/306 X |
| 4,747,510 | 5/1988 | Mack | 220/306 X |
| 4,939,332 | 7/1990 | Hahn | 219/10.55 E |
| 5,147,059 | 9/1992 | Olsen et al. | 220/306 X |

*Primary Examiner*—Steven M. Pollard

[57] ABSTRACT

A stacking tray and lid assembly has a tray with an upper surface and a multiplicity of depending compartments for receiving food. The compartments are spaced inwardly from the side margins of the tray to provide a peripheral portion thereabout. The lid has a generally planar body and a depending peripheral flange with a multiplicity of bosses on the inner surface of the flange which engage the outer edge of the peripheral portion of the tray.

10 Claims, 6 Drawing Sheets

FIG. 1
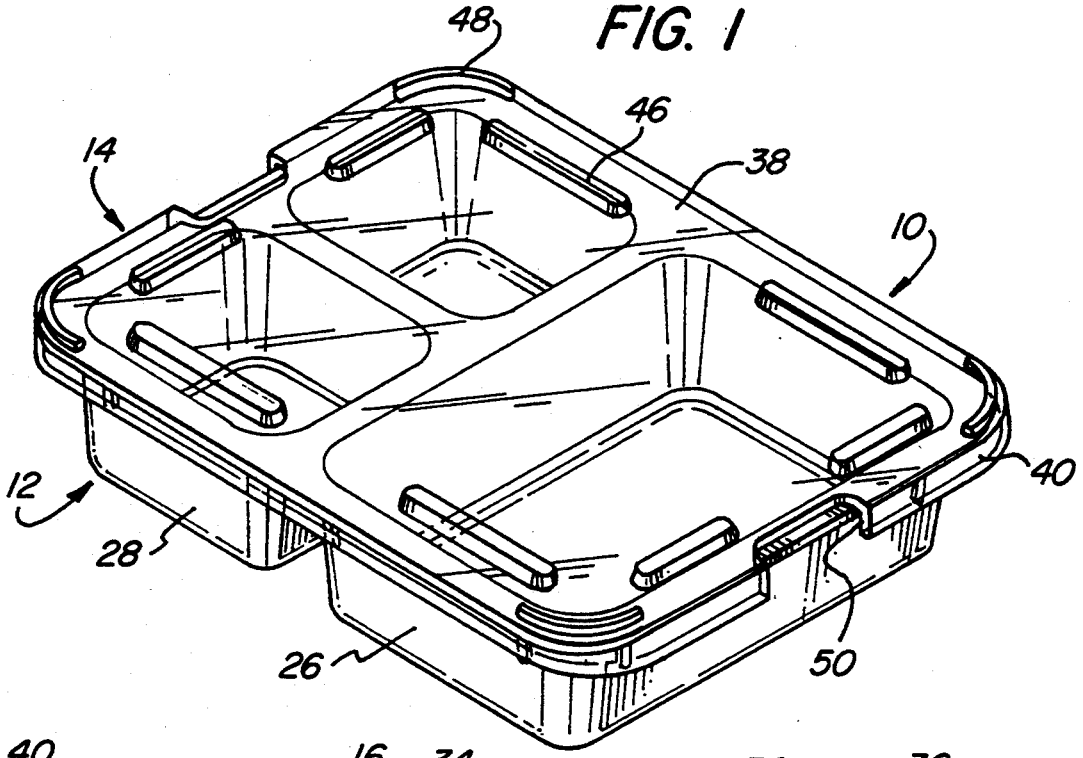
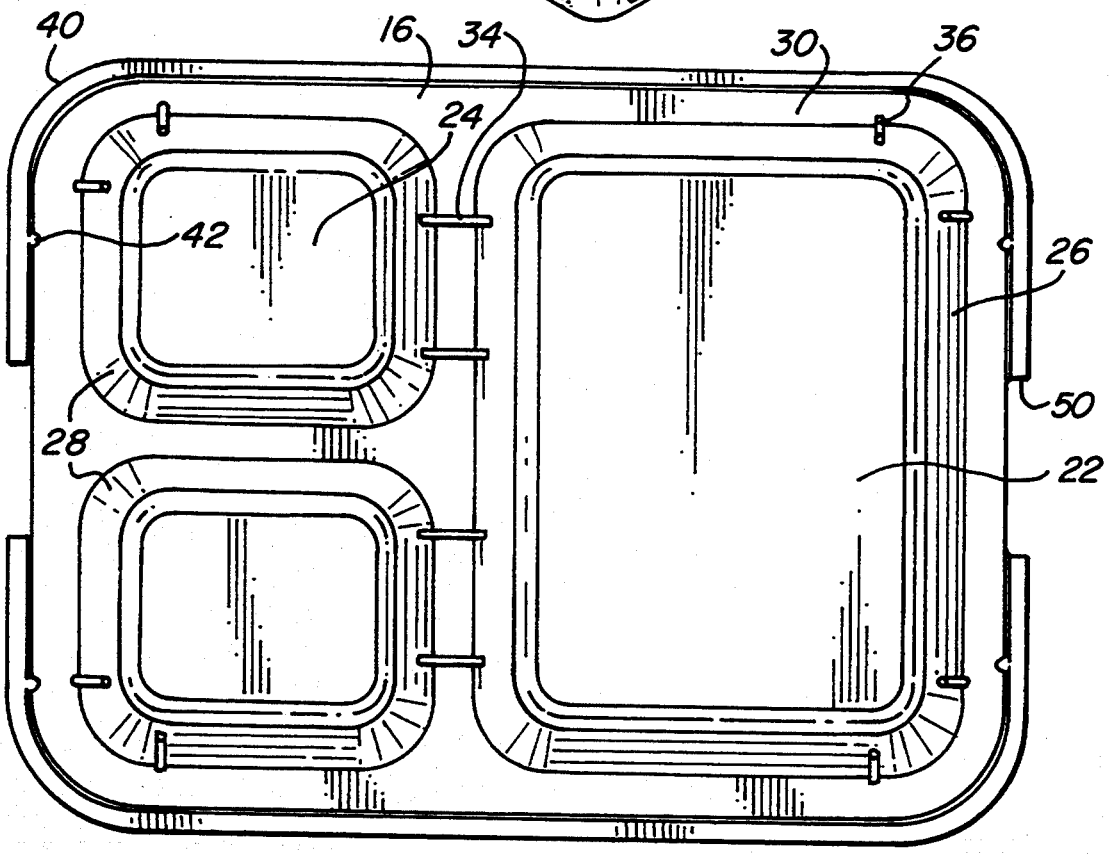
FIG. 2

FIG. 11
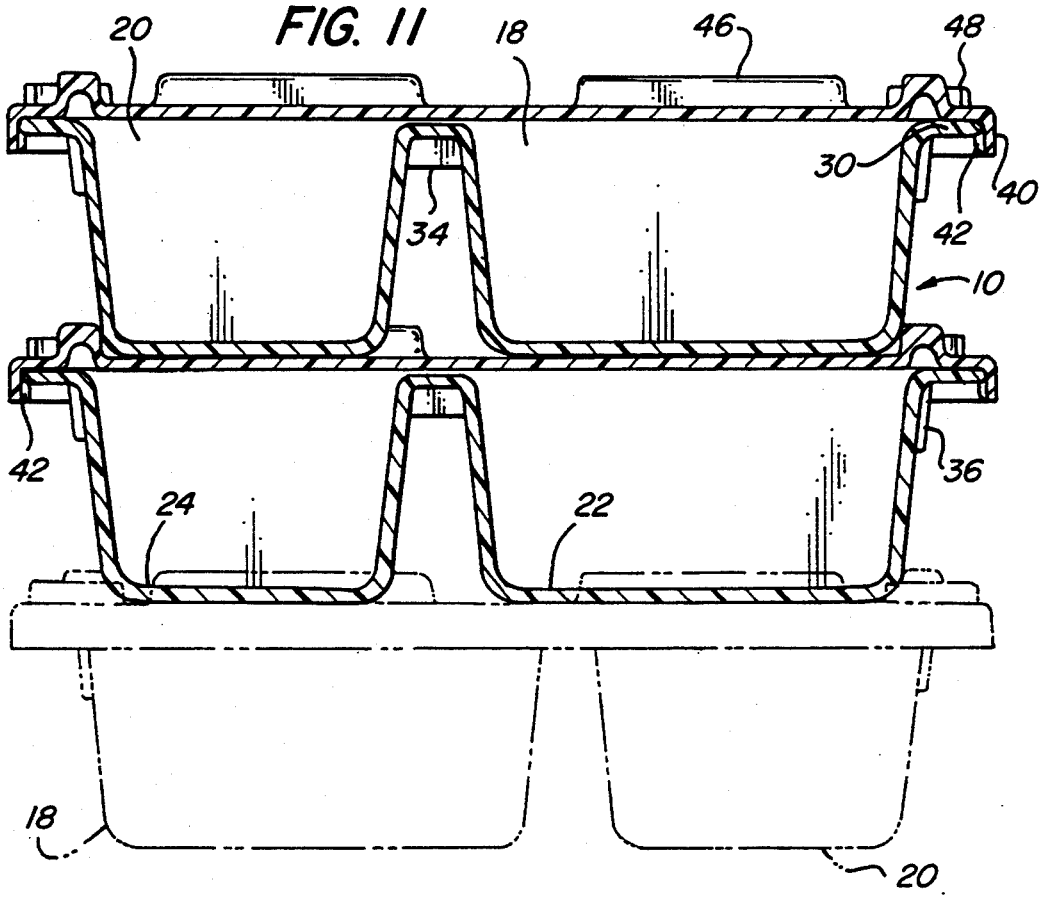
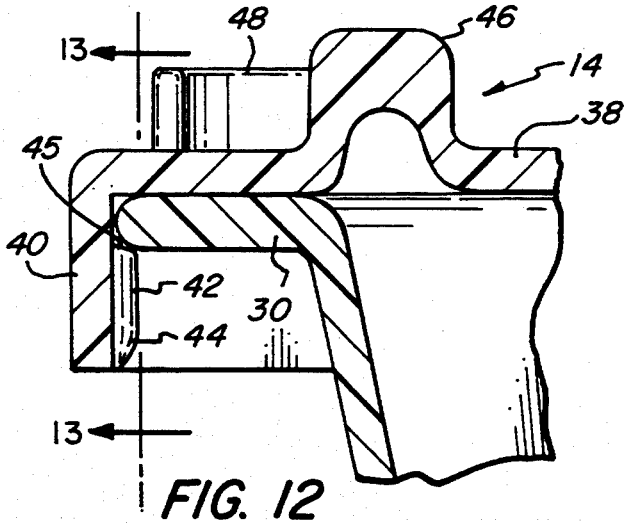
FIG. 12
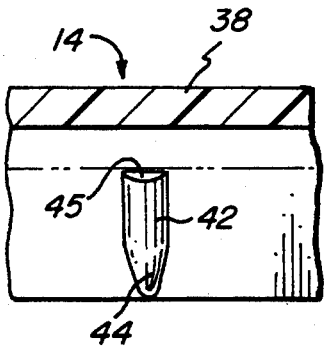
FIG. 13

STACKING TRAY AND LID ASSEMBLY

BACKGROUND OF THE INVENTION

The present invention relates to a stacking tray and lid assembly for containing food, and, more particularly, to a stacking tray and lid assembly which provides secure engagement between the lid and the tray.

Tray and lid assemblies for the containment of food are well known in the art because they are commonly used in various types of institutions and on common carriers. Such trays are usually compartmentalized to enable service of complete meals and the trays and lids are made of materials to facilitate retention of heat in the food in the compartments. Generally, reusable lids have depending peripheral flanges which functionally engage the peripheral edge of the tray. Some lids are weakly bonded to the upper surface of the tray.

Frictionally engaged lids which fit too loosely allow for spillage or premature cooling. Lids which fit tightly lead to frustration or spillage in the covering or uncovering process. Lids that may fit properly when the assembly is new, may fit less effectively as wear alters the dimensions of the lid or tray. Manufacturing fluctuations in tolerances may also lead to ineffective engagement of the lids.

It is an object of the present invention to provide a novel stacking tray and lid assembly for containing food in which the lid is firmly engaged with the tray.

It is also an object to provide such an assembly which accommodates variations in tolerance in manufacturing and wear of the engaging surfaces.

Another object is to provide such a stacking tray and lid assembly which permits lids and trays to be separately stacked in interfitting relationship to minimize storage space.

A further object is to provide such a stacking tray and lid assembly which may be fabricated readily and relatively economically.

SUMMARY OF THE INVENTION

It has now been found that the foregoing and related objects may be readily attained in a stacking tray and lid assembly for food which includes a tray with an upper surface and a multiplicity of compartments for receiving food. The compartments depend from the upper surface and are spaced inwardly from the side margins of the tray to provide a peripheral portion thereabout. The compartments have a sidewall and a generally coplanar bottom walls extending parallel to the upper surface. The lid has a generally planar body and a depending peripheral flange. A multiplicity of bosses are located on the inner surface of the flange and engage the outer edge of the peripheral portion of the tray.

Preferably, the bosses are spaced downwardly from the upper end of the peripheral flange a distance greater than the thickness of the edge of the peripheral of the tray, and the peripheral portion sits above the bosses. Preferably, the bosses are vertically elongated and have an outwardly inclined surface at their lower ends to facilitate their movement over the edge of the tray, and the flange of the lid is resiliently deflectable during passage of the bosses over the edge of the tray.

Desirably, the peripheral portion of the body of the lid has a multiplicity of upstanding positioning ribs thereon. The ribs are oriented to receive therebetween the lower portions of the sidewalls of the compartments of another tray seated on the lid.

BRIEF DESCRIPTION OF THE DRAWINGS

FIG. 1 is a perspective view of a stacking tray and lid assembly embodying the present invention;

FIG. 2 is a bottom plan view thereof drawn to an enlarged scale;

FIG. 11 is a cross sectional view thereof, in enlarged scale, along the line 11—11 of FIG. 10, with an additional tray/lid assembly in phantom line shown rotated 180 degrees with respect to the other two assemblies;

FIG. 12 is a fragmentary sectional view to an enlarged scale, of the corner of a tray and lid; and FIG. 13 is a fragmentary cross sectional view thereof along the line 13—13 of FIG. 12.

DETAILED DESCRIPTION OF THE PREFERRED EMBODIMENT

Turning first to FIG. 1, a stacking tray and lid assembly embodying the present invention is generally designated by the numeral 10 and is illustrated therein as having a tray generally designated by the numeral 12, and a lid generally designated by the numeral 14.

Figure 3:
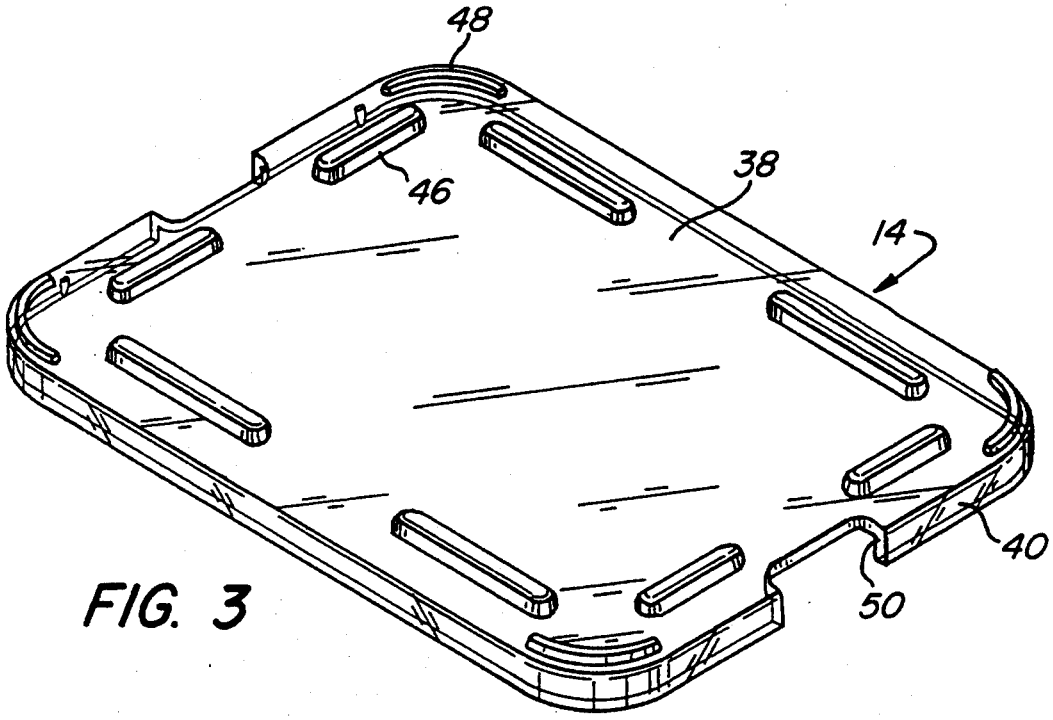
FIG. 3 is a perspective view of the lid.
Figure 4:
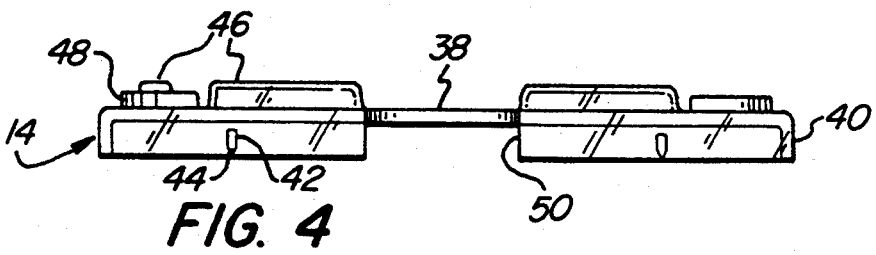
FIG. 4 is a side elevational view thereof.
Figure 5:
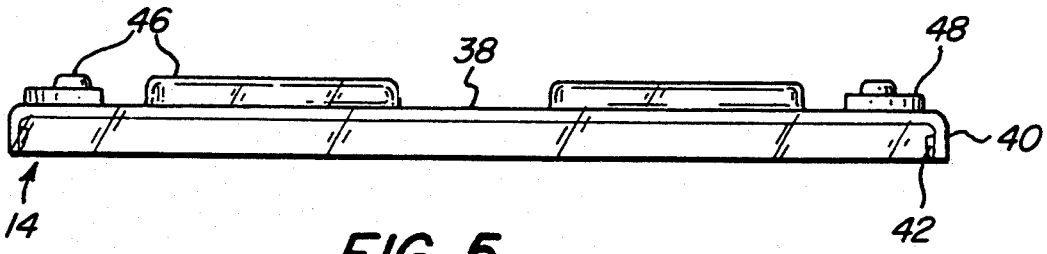
FIG. 5 is a front elevational view thereof.
Figure 6:
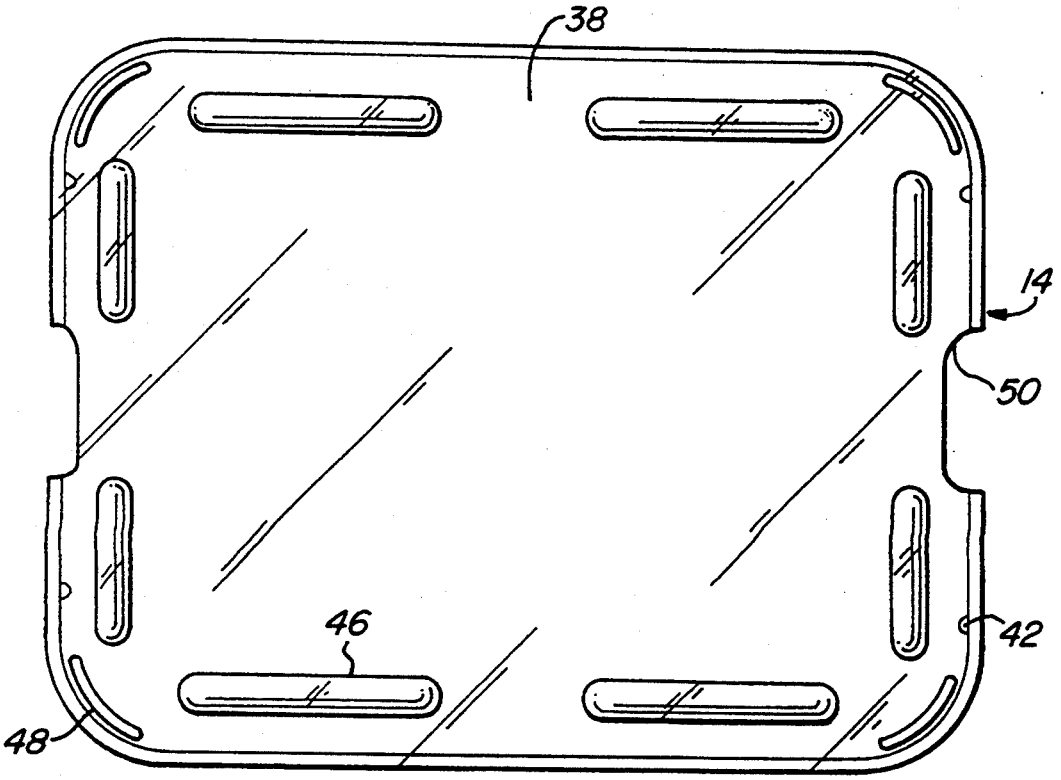
FIG. 6 is a top plan view thereof drawn to an enlarged scale.
Figure 7:
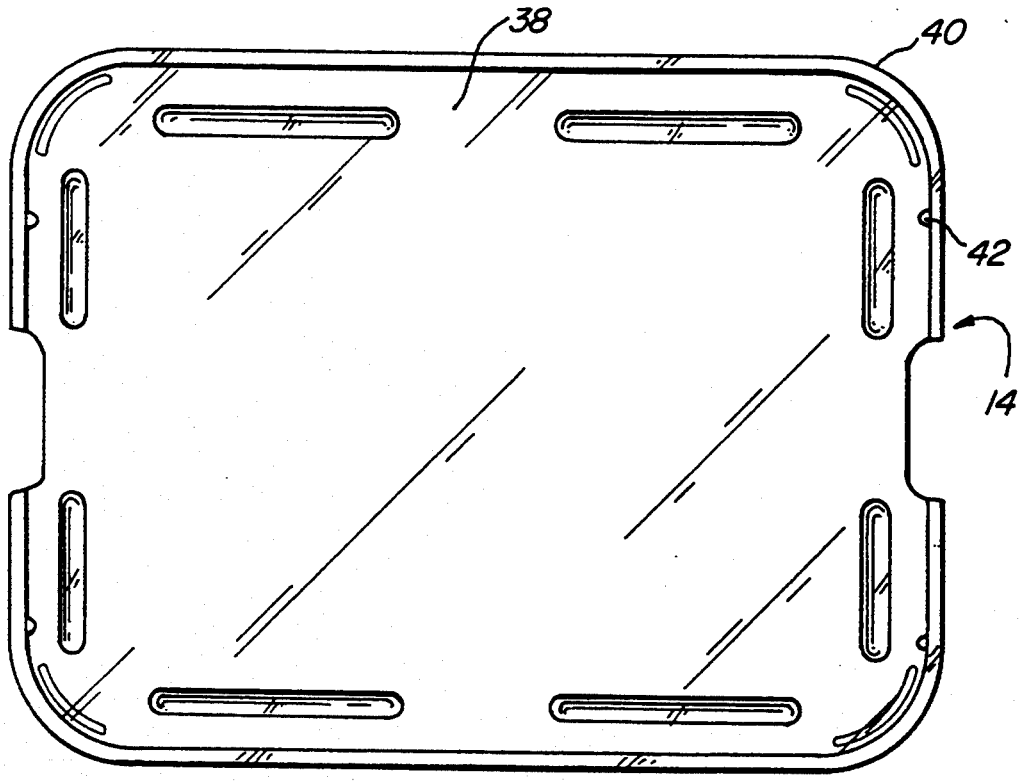
FIG. 7 is a bottom plan view thereof.
Figure 8:
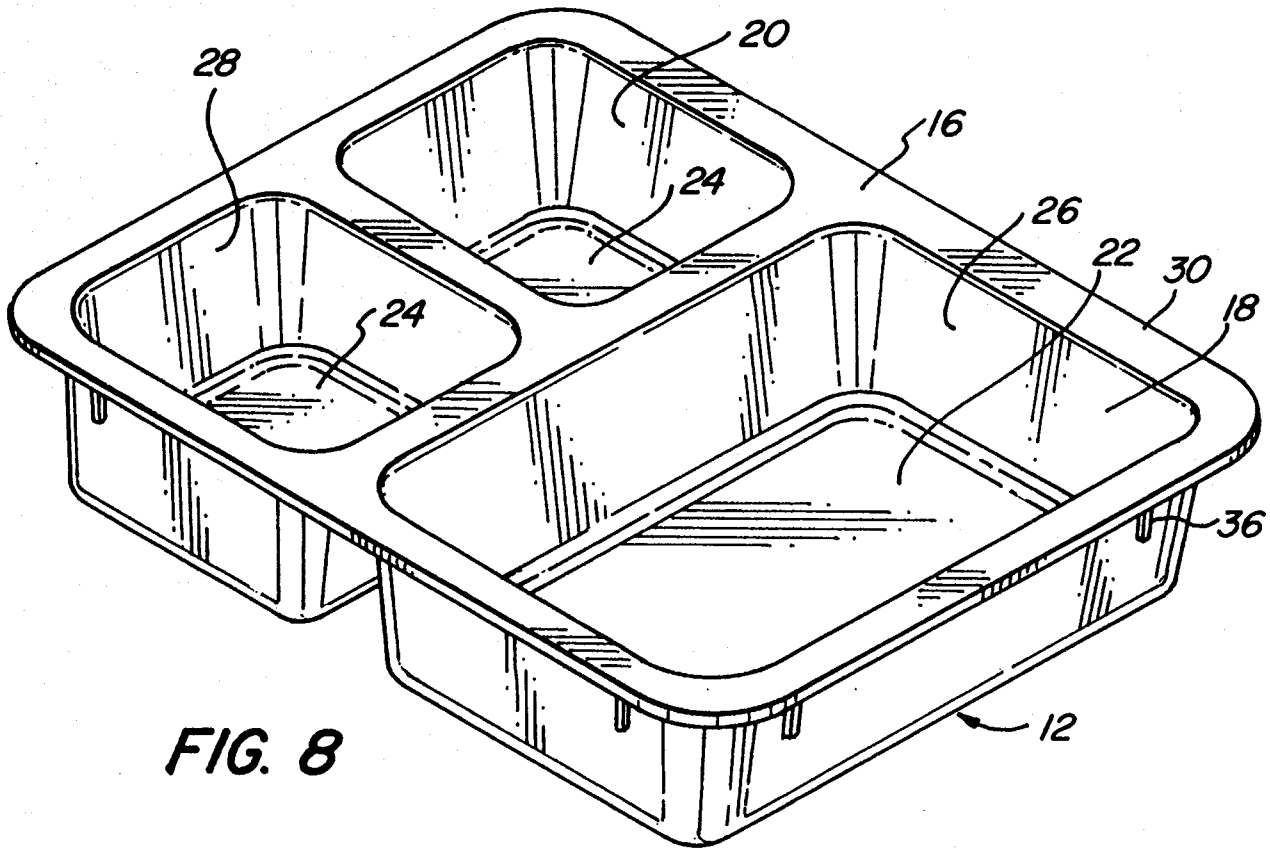
FIG. 8 is a perspective view of the tray.

As best seen in FIG. 8, the tray 10 has an upper surface 16 and is provided with one large compartment 18 and two small compartments 20 which depend therefrom and are spaced inwardly from its side margins to provide a peripheral portion 30 thereabout. The compartments 18, 20 have generally planar bottom walls 22, 24 respectively, which are coplanar and parallel to the upper surface 16. A sidewall 26, 28 respectively, extends upwardly from the periphery of each of the bottom walls 22, 24 to the upper surface 16, thereby providing recesses 18, 20 to receive food.

Figure 9:
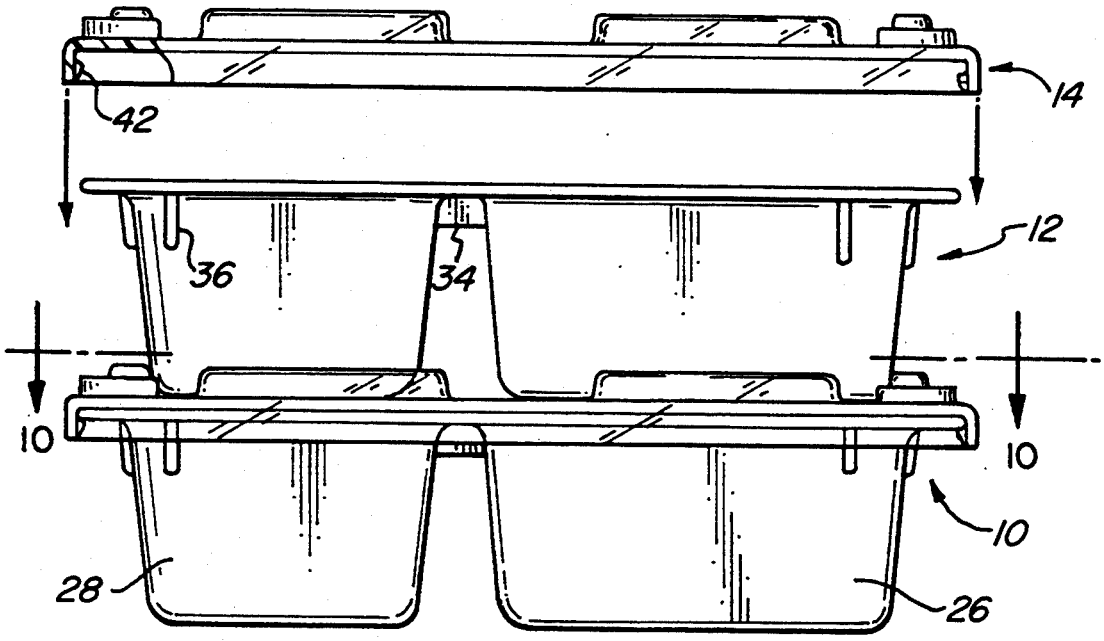
FIG. 9 is a front elevational view of a stacked pair of lid and tray assemblies with the lid for the upper tray spaced from it and a portion of the lid associated with the upper tray being cut away to show detail of an abutment rib.

As best seen in FIGS. 2 and 9, a number of reinforcing ribs 34 depend from the upper surface 16 and extend between adjacent portions of the sidewall 26 of the large compartment 18 and the sidewalls 28 of the small compartments 20 to provide increased rigidity to the tray 12.

On each of the outwardly facing corners of the outer surfaces of the sidewalls 26, 28 are vertically disposed tray stacking ribs 36. The trays 12 may be stacked by placing the compartments 18, 20 of one tray 12 inside the corresponding compartments 18, 20 of a tray 12 stacked below it. The tray stacking ribs 36 provide spacing between the inner surfaces of the sidewalls 26, 28 and bottom walls 22, 24 of one tray 12 and the outer surfaces of the sidewalls 26, 28 and bottom walls 22, 24 of another tray 12 stacked above it, thereby providing ease in separation.

Referring to FIGS. 3–7, the lid 14 has a generally planar body 38 and a depending peripheral flange 40. The depending flange 40 is dimensioned to extend outwardly of and engage the outer edge of the peripheral portion 30 of the tray 12.

On the inner surface of the depending flange 40, along the ends of the lid 14 are pairs of vertically extending bosses 42, which are adapted to engage the outer edge of the peripheral portion 30 of the tray 12. As seen in FIG. 13, the bosses 42 are spaced downwardly from the upper end of the inner surface of the flange 40 a distance slightly greater than the thickness of the peripheral portion of the tray 12 so that its edge seats thereabove. As best seen in FIGS. 12 and 13, the lower portion of each vertically extending boss 42 is provided with downwardly tapering surface 44 to permit the sliding of the lid 14 over the peripheral portion 30, and deflection of the flange 40 to permit the bosses 42 to pass over the edge and snap therebehind. The top surface of the boss 42 forms a shoulder 45 upon which the lower surface of the peripheral portion 30 rests when the lid 14 is fully pressed onto the tray 12. It can be seen that, as the lid 14 is pressed upon the tray 12, the outer edge of the peripheral portion 30 abuts the tapered surface 44, slides along the outer surface of the boss 42 until the edge seats on the shoulder 45. The space between the shoulder 45 and the upper end of the depending peripheral flange 40 is dimensioned to exceed by a small amount the thickness of the edge of the peripheral portion 30 and thereby snugly receive it.

Figure 10:
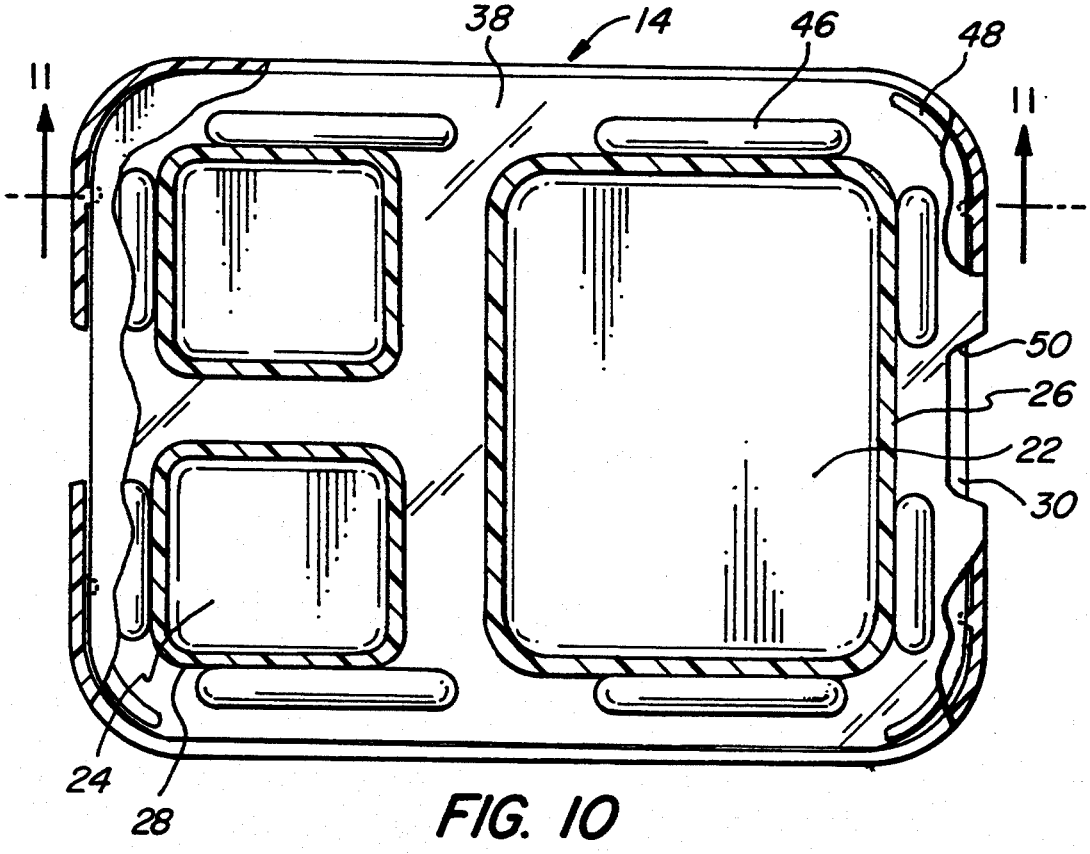
FIG. 10 is a cross sectional view thereof along the line 10—10 of FIG. 9, with parts of the lid broken away to show detail of the flange of the tray disposed above bosses of the lid.

On the peripheral portion of the generally planar body 38 of the lid 14 are upstanding positioning ribs 46 which are spaced apart and disposed in a substantially rectangular configuration. The positioning ribs 46 are spaced inwardly from the margins of the top wall 38 so as to receive between them the lower portions of the sidewalls 26, 28 of the compartments 18, 20 of a tray 12 stacked upon the lid 14 as seen in FIGS. 9 and 10. In this manner, the positioning ribs 46 prevent unintentional lateral shifting of a tray 12 which is stacked upon the lid 14.

Also on the peripheral portion of the generally planar body 38 of the lid 14 and adjacent each corner of the body 38 are arcuate lid stacking ribs 48 adapted to abut portions of the inner surface of the depending peripheral flange 40 of a lid 14 stacked thereon. When the lids 14 are stacked, the lid stacking ribs 48 prevent unintentional lateral shifting of the lids 14 and facilitate their separation vertically.

Intermediate the length of each end of the body 38, a notch 50 is provided in the body 38 and flange 40 facilitate flexing of the flange 40 and disengagement of the lid 14 from the tray 12.

In use, the stacking tray and lid assembly 10 is assembled by pressing the lid 14 over the tray 12 to allow the depending peripheral flange 40 of the lid 14 to engage the outer edge of the peripheral portion 30 of the tray 12. As the lid 14 is pushed down upon the tray 12, the flange 40 resiliently deflects and bosses 42 snap behind the outer edge of the peripheral portion 30, in the manner discussed above. The bosses 42 thereby maintain secure engagement with the peripheral portion 30 despite variations in the dimensions of the lid 14 and the tray 12 which may occur from manufacturing tolerances and despite normal wear or erosion of the surfaces.

The lid may be conveniently removed by pushing down on the portion of the upper surface of the peripheral portion 30 which is exposed through the cut-out 50, while pulling upwardly and slightly outwardly on adjacent portions of the depending flange 40. This motion serves to disengage the peripheral portion 30 from the shoulder 45.

The novel design of the stacking tray and lid assembly 10 enables several possible stacking arrangements. As shown in FIGS. 9–11, tray/lid assemblies 10 may be stacked securely as a result of the positioning ribs of one assembly 10 preventing lateral movement of the assembly 10 stacked above it. As best seen in FIG. 11, the assemblies 10 may be stacked in an aligned fashion as shown in solid line, or in an alternating fashion as shown in phantom line. Similarly, the lids 14 and the trays 12 may be separately stacked, and conveniently separated.

The tray and the lid 12 may be fabricated from any polymer that affords resistance to heat and the desired flexibility. Polysulphone and polycarbonate resins have been quite satisfactory.

Although one larger compartment 18 and two smaller compartments 20 have been illustrated in the tray, the number of compartments 18, 20, as well as their size and relative placement, may be altered to suit the needs of the user. Also, trays and lids having cross sections of different shapes may be employed. The number and location of the abutment ribs 42 may then be selected to provide secure seating.

Thus, it can be seen from the foregoing detailed specification and attached drawings that the lid is firmly engaged with the tray in an assembly which accommodates tolerances in manufacturing and wear of the engaging surfaces. Additionally, the stacking tray and lid assembly permits lids and trays to be stacked in interfitting relationship to minimize storage space. The components may also be fabricated readily and relatively economically.

Having thus described the invention, what is claimed is:

1. A stacking tray and lid assembly for food, comprising:

(a) a tray of generally rectangular configuration having an upper surface and a multiplicity of compartments for receiving food, depending from said upper surface and spaced inwardly from the side margins of said tray to provide a peripheral portion thereabout, said compartments having a sidewall and a generally planar bottom wall extending parallel to said upper surface, said bottom walls being coplanar; and (b) a lid of cooperating generally rectangular configuration with two pairs of opposed sides and including a generally planar body and a depending peripheral flange with cutouts extending through said flange on a pair of opposite sides of said lid, said flange on each of said pair of opposite sides having a multiplicity of bosses formed on its inner surface and protecting inwardly therefrom into engagement below the outer edge of said peripheral portion of said tray, said bosses being disposed on opposite sides of said cutouts, said cutouts facilitating flexing of said flange to enable said bosses to pass over said outer edge of said tray.

2. The stacking tray and lid assembly in accordance with claim 1 wherein said bosses are spaced downwardly from the upper end of said peripheral flange a distance greater than the thickness of said edge of said tray peripheral portion which seats thereabove.

3. The stacking tray and lid assembly in accordance with claim 1 wherein said bosses have an outwardly inclined surface at their lower ends to facilitate movement thereof over the edge of said tray.

4. The stacking tray and lid assembly in accordance with claim 1 wherein said bosses are vertically elongated.

5. The stacking tray and lid assembly in accordance with claim 1 wherein the peripheral portion of said body of said lid has a multiplicity of upstanding positioning ribs thereon oriented to receive therebetween the lower portions of the sidewalls of the compartments of a tray seated thereon.

6. A stacking tray and lid assembly for food, comprising:

(a) a tray of generally rectangular configuration having an upper surface and multiplicity of compartments for receiving food, depending from said upper surface and spaced inwardly from the side margins of said tray to provide a peripheral portion thereabout, said compartments having a sidewall and a generally planar bottom wall extending parallel to said upper surface, said bottom walls being coplanar; and (b) a lid of cooperating generally rectangular configuration with two pairs of opposed sides and including a generally planar body and a depending peripheral flange with cutouts extending through said flange on a pair of opposite sides of said lid, said flange on each of said pair of opposite sides having a multiplicity of bosses on its inner surface into engagement below the outer edge of said peripheral portion of said tray, said bosses being disposed on opposite sides of said cutouts, said cutouts facilitating flexing of said flange to enable said bosses to pass over said outer edge of said tray, said bosses being vertically elongated and having an inclined surface at their lower ends to facilitate movement thereof over the edge of said tray, said bosses being spaced downwardly from the upper end of said peripheral flange a distance greater than the thickness of said edge of said tray peripheral portion which engages thereabove.

7. The stacking tray and lid assembly in accordance with claim 6 wherein the peripheral portion of said body of said lid has a multiplicity of upstanding positioning ribs thereon oriented to receive therebetween the lower portions of the sidewalls of the compartments of a tray seated thereon.

8. A stacked tray assembly comprising:

(a) a first tray of generally rectangular configuration having an upper surface and multiplicity of compartments for receiving food, depending from said upper surface and spaced inwardly from the side margins of said tray to provide a peripheral portion thereabout, said compartments having a sidewall and a generally planar bottom wall extending parallel to said upper surface, said bottom walls being coplanar;

(b) a lid of cooperating generally rectangular configuration with two pairs of opposed sides and including a generally planar body and a depending peripheral flange with cutouts extending through said flange on a pair of opposite sides of said lid, said flange on each of said pair of opposite sides having a multiplicity of bosses on its inner surface into engagement below the outer edge of said peripheral portion of said tray, said bosses being disposed on opposite sides of said cutouts, said cutouts facilitating flexing of said flange to enable said bosses to pass over said outer edge of said tray, said lid having a multiplicity of upstanding positioning ribs on said peripheral portion; and (c) a second tray seated on said lid, said tray having an upper surface and multiplicity of compartments for receiving food, said compartments depending from said upper surface and being spaced inwardly from the side margins of said tray to provide a peripheral portion thereabout, said compartments having a sidewall and a generally planar bottom wall extending parallel to said upper surface and said bottom walls being coplanar, said positioning ribs of said lid receiving therebetween the lower portions of the sidewalls of the compartments of a tray seated thereon.

9. The stacked tray assembly in accordance with claim 8 wherein said bosses are spaced downwardly from the upper end of said peripheral flange a distance greater than the thickness of said edge of said tray peripheral portion which seats thereabove.

10. The stacked tray assembly in accordance with claim 8 wherein said bosses are vertically elongated and have an outwardly inclined surface at their lower ends to facilitate movement thereof over the edge of said tray.

* * * * *

UNITED STATES PATENT AND TRADEMARK OFFICE

CERTIFICATE OF CORRECTION

PATENT NO. : 5,419,451
DATED : May 30, 1995
INVENTOR(S) : Vincent J. Bitel, Jr.

It is certified that error appears in the above-indentified patent and that said Letters Patent is hereby corrected as shown below:

Column 4, line 57, delete "protecting" and insert --projecting--.

Signed and Sealed this

Twenty-sixth Day of September, 1995

*Attest:*

BRUCE LEHMAN

*Attesting Officer*

*Commissioner of Patents and Trademarks*